US006050113A

United States Patent [19]

Skrippek et al.

[11] Patent Number: 6,050,113

[45] Date of Patent: Apr. 18, 2000

[54] DRIVE DEVICE FOR A WASHING MACHINE

[75] Inventors: Jörg Skrippek, Priort; Reinhard Heyder, Berlin, both of Germany

[73] Assignee: BSH Bosch und Siemens Hausgeraete GmbH, Munich, Germany

[21] Appl. No.: 09/096,976

[22] Filed: Jun. 12, 1998

[30] Foreign Application Priority Data

Jun. 12, 1997 [DE] Germany ..... 197 24 930

[51] Int. Cl.[7] ..... D06F 37/30

[52] U.S. Cl. ..... 68/140; 68/58

[58] Field of Search ..... 68/12.16, 24, 140, 68/58

[56] References Cited

U.S. PATENT DOCUMENTS

| | | | |
|---|---|---|---|
| 5,809,809 | 9/1998 | Neuman | 68/140 |
| 5,862,686 | 1/1999 | Skrippek | 68/140 |
| 5,894,746 | 4/1999 | Skrippek | 68/140 |

*Primary Examiner*—Frankie L. Stinson

*Attorney, Agent, or Firm*—Herbert L. Lerner; Laurence A. Greenberg; Werner H. Stemer

[57] ABSTRACT

A washing machine includes a tub having a bottom wall and a laundry drum having an at least approximately horizontally disposed shaft. A drive device for the washing machine includes a flat motor for directly driving the laundry drum shaft. The motor includes a rotor having a rotor shaft and a stator connected to the bottom wall of the tub instead of to a rigid carrying part with a bearing sleeve for the laundry drum shaft. The stator has a central bearing sleeve with one or two spaced-apart rolling bearings for the rotor shaft. The rotor shaft has an end facing the laundry drum with a concentric bore for receiving the laundry drum shaft. The bore reaches approximately into a plane of the drum-side rolling bearing. The rotor has a bell fastened to an outer end of the rotor shaft with an edge pointing toward the tub. Magnetizable poles are distributed on the inner periphery of the edge and across airgaps oppose a number of exciting windings distributed circularly on the stator. The drive for the horizontally mounted laundry drum has a cost-effective construction, the motor may be fully preassembled at the factory where it is manufactured and the stator may replace an otherwise conventional star carrier for the tub.

7 Claims, 2 Drawing Sheets

DRIVE DEVICE FOR A WASHING MACHINE

BACKGROUND OF THE INVENTION

Field of the Invention

The invention relates to a drive device for a washing machine, having a laundry drum mounted through an at least approximately horizontally disposed shaft within a bearing sleeve of a rigid carrying part attached to a bottom wall of a tub and driven directly by a flat motor likewise attached to the rear side of the tub.

Such drive devices are known from German Published, Non-Prosecuted Patent Applications DE 39 27 426 A1 and DE 43 41 832 A1 . In those devices, the stator of the motor, which is constructed as a commutatorless external-rotor direct current motor, is fastened directly to the bearing sleeve of the rigid carrying part. The shaft is mounted in the bearing sleeve and has an outer end connected fixedly in terms of rotation to the rotor of the motor. In that case, the rotor is a so-called external rotor which engages as a can over the stator windings and which carries poles constructed as permanent magnets. In the washing machine according to German Published, Non-Prosecuted Patent Application DE 43 41 832 A1, the motor is additionally surrounded by an insulating hood which damps noises radiated directly from the motor into the ambient atmosphere.

The known drive devices encase the stator, which is exposed to considerable thermal load due to Joule heat in its windings, through the use of a can-shaped rotor (and additionally through the use of the sound insulating hood in the case of German Published, Non-Prosecuted Patent Application DE 43 42 832 A1) to such an extent that cooling of the motor fails altogether. Above all, inability to cool is exacerbated by the fact that a directly driving motor of that type has difficulty in cooling itself through the use of the rotating rotor, because it necessarily has low inherent rotational speeds. The known drive devices can therefore only be used in practice when they are protected against rapid overheating through the use of separate cooling.

Moreover, the known drive devices cannot be delivered as ready-assembled motors to the factory manufacturing the washing machines. Their stators and rotors have to be delivered separately and can only be assembled together at the washing machine factory. As a rule, a washing machine factory does not have special assembly equipment available for the completion of motor subassemblies, and is also not desired. Therefore, the stator subassembly which is initially to be connected to the tub system is usually completed with the external rotor subassembly without any great accuracy. Since extremely stringent requirements are placed on maintaining a small airgap between the stator poles and rotor poles, if possible the airgap is always of equal size in each article, and the above-mentioned assembly in a washing machine factory does not satisfy those requirements on centered mounting, in practice the known drive device can only be used with great reservations.

SUMMARY OF THE INVENTION

It is accordingly an object of the invention to provide a drive device for a washing machine, which overcomes the hereinafore-mentioned disadvantages of the heretofore-known devices of this general type and which is constructed more cost-effectively. In addition, the motor is to be capable of being completed and tested in the motor manufacturer's factory before it is installed on the premises of a washing machine manufacturer, and finally it is to be constructed in such a way that it can also perform the function of carrying a tub.

With the foregoing and other objects in view there is provided, in accordance with the invention, in a washing machine including a tub having a bottom wall, and a laundry drum having an at least approximately horizontally disposed shaft, a drive device for the washing machine, comprising a flat motor for directly driving the laundry drum shaft, the motor including a stator connected to the bottom wall of the tub (instead of to a rigid carrying part with a bearing sleeve for the laundry drum shaft) and a rotor having a rotor shaft with an outer end; the stator having a central bearing sleeve with between one and two mutually spaced-apart rolling bearings for the rotor shaft including a drum-side rolling bearing defining a plane, and a number of exciting windings with laminated cores distributed circularly on the stator; the rotor shaft having an end facing the laundry drum, the end having a concentric bore formed therein for receiving the laundry drum shaft, the bore reaching approximately into the plane of the drum-side rolling bearing; and the rotor having a bell fastened to the outer end of the rotor shaft, the bell having an edge pointing toward the tub, the edge having an inner periphery, and magnetizable poles distributed on the inner periphery and opposing the exciting windings defining airgaps therebetween.

The structure according to the invention gives the motor a cost-effective form of construction, by virtue of which it is possible to have shorter shaft journals on the laundry drum which requires a smaller structural space during transport. This is because the shaft length that is necessary for the motor in any case, already takes up the structural space which is required. Constructing the stator through the use of the elements of a rigid carrying part makes it possible to replace the star carrier for the tub. This avoids the need for additional costs in constructing the tub.

Moreover, the motor can thereby be fully assembled and tested at the manufacturing factory of the motor supplier. The assembly and test aids which are suitable for this purpose are available there, so that motor subassemblies are always assembled with the same degree of accuracy and can be delivered to the washing machine factory.

In accordance with another feature of the invention, the shaft of the laundry drum introduced into the concentric bore is fastened in the bore from outside the rotor shaft through the use of a tension screw. Therefore, instead of using a cast star carrier which is otherwise conventional at this point, on the bottom wall of the tub system, in order to mount this subassembly the stator of the complete motor can be fastened, for example, to the periphery of the bottom wall of the tub through the use of a plurality of screws, before the shaft of the laundry drum is inserted from the front into the hub of the rotor. At that time the rotor is already connected to the stator through the rolling bearings and is secured from the rear through the use of a central screw. These operations are virtually identical to those for fastening a star carrier and a belt pulley according to the washing machine structures which were customary heretofore, so that the assembly personnel do not have to learn completely different operations.

In accordance with a further feature of the invention, the shaft of the laundry drum and the bore have mutually matching cones of low inclination. Therefore, the fit of the laundry drum shaft in the rotor shaft can be considerably improved, without the possible risk of the tension screw coming loose.

In accordance with an added feature of the invention, the cones have an angle of inclination which results in self-locking, in the case of a given material pairing. The risk of loosening is then even virtually ruled out.

In accordance with an additional feature of the invention, the rotor shaft and the bell are releasably connected to one another, which is highly advantageous. Since the bell can be removed together with the magnetizable poles, there is very easy access to the exciting windings. It is therefore no problem to exchange an exciting winding of this type if it is defective.

In accordance with yet another feature of the invention, the stator has an annular part of its portion running essentially parallel to the bottom wall of the tub and has a collar-like part for fastening the exciting windings, on one hand, and the bell and the edge of the bell, on the other hand, form an annular cavity. This is done for the sake of an easier and reproducibly accurate assembly of the exciting windings and magnetizable poles.

In accordance with a concomitant feature of the invention, there are provided gaps between the edge and the annular stator part, on one hand, and between the bell and the collar-like stator part, on the other hand, which are sealed off by labyrinth-like shaping against a penetration of magnetizable foreign bodies.

Other features which are considered as characteristic for the invention are set forth in the appended claims.

Although the invention is illustrated and described herein as embodied in a drive device for a washing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
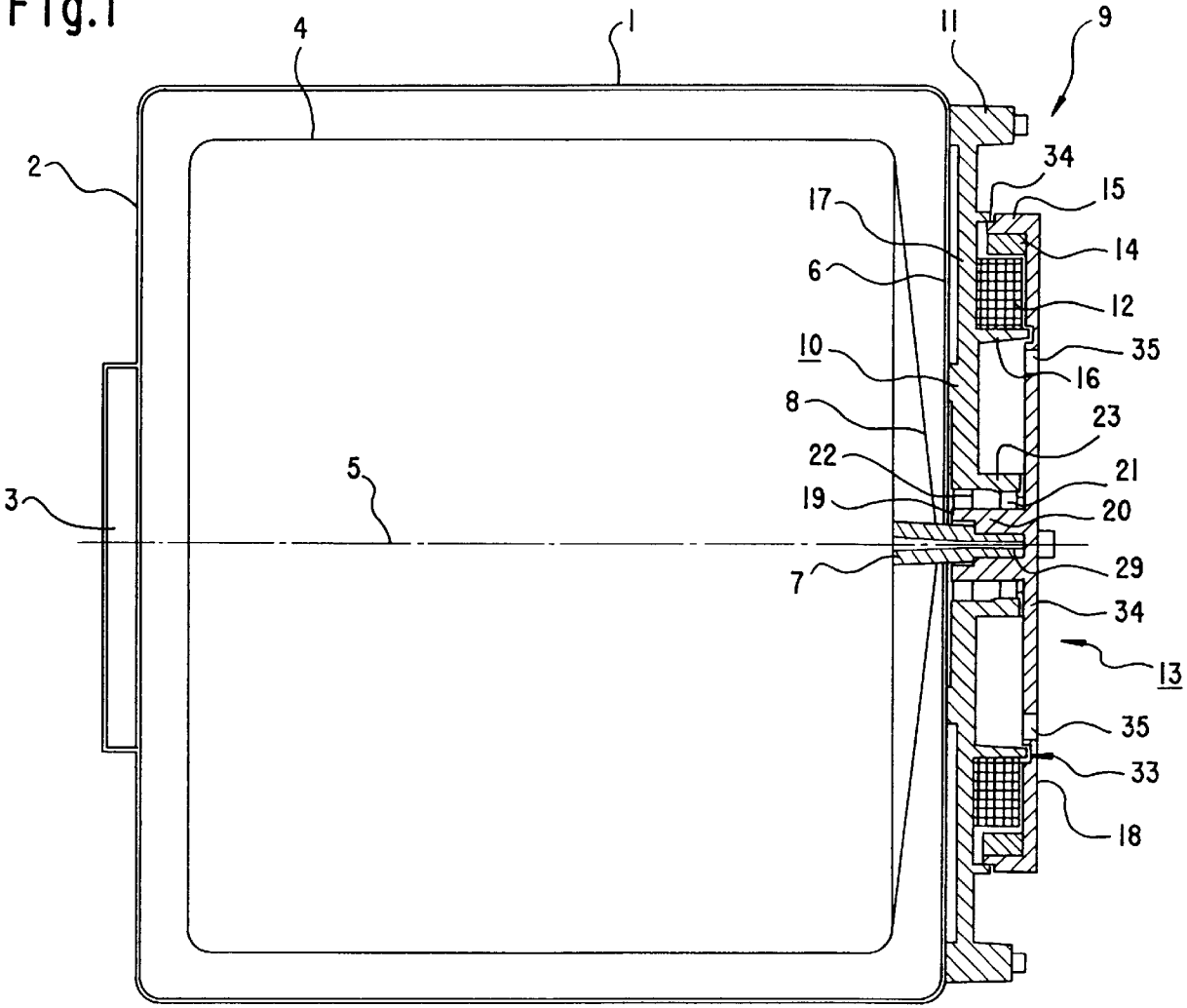
FIG. 1 is a diagrammatic, partly-sectional view of a washing machine tub having an internally horizontally mounted laundry drum with a drive shaft mounted jointly with a hub of a rotor bell in a bearing sleeve of a stator.

Referring now to the figures of the drawings in detail and first, particularly, to FIG. 1 thereof, there is seen a tub 1 that is mounted in a non-illustrated oscillating manner, in a likewise non-illustrated housing of a washing machine. The tub 1 has a front wall 2 with an orifice 3 for loading and unloading a laundry drum 4 which is mounted rotatably about a horizontally disposed axis 5 in a bottom wall 6 of the tub 1. This mounting of the laundry drum 4 is provided by a shaft 7 which is connected fixedly in terms of rotation to a rear wall 8 of the laundry drum 4.

A flat or pancake motor 9 which is mounted on the bottom wall 6 of the tub 1 has a stator or stator carrying part 10 that is connected fixedly in terms of rotation to the periphery of the bottom wall 6 by a flange 11. A plurality of exciting windings 12 are distributed on a collar-like part 16 of an annular part 17 of a portion of the stator 10 which runs essentially parallel to the bottom wall 6. During rotation of a rotor 13, the exciting windings 12 alternately come into correspondence, through airgaps 37 (FIG. 2), with magnetizable poles 14 of the rotor which are likewise distributed segmentally on an inner periphery of an edge 15 of a bell 18 of the rotor 13. A magnetic return of the magnetic segments 14 is formed by the ferromagnetic edge 15. The motor can thereby introduce its driving torques into the laundry drum 4 directly through a journal of the shaft 7. In this case, the stator 10 of the motor 9 also absorbs all of the bearing forces in the same way as a star carrier which it replaces.

The shaft 7 of the laundry drum 4 is kept very short and only projects into a short cone 19 of a rotor shaft 20. This shaft 20 is mounted through roller bearings 21 and 22 in a bearing sleeve 23 of the stator 10. The shaft 20 has an end with the cone 19 pointing toward the laundry drum 4 and reaches into a plane of the inner rolling bearing 22. As a result, the laundry drum 4, together with its short shaft 7, takes up only a small stowage space for possible transport, as compared with known drive devices of this type.

Figure 2:
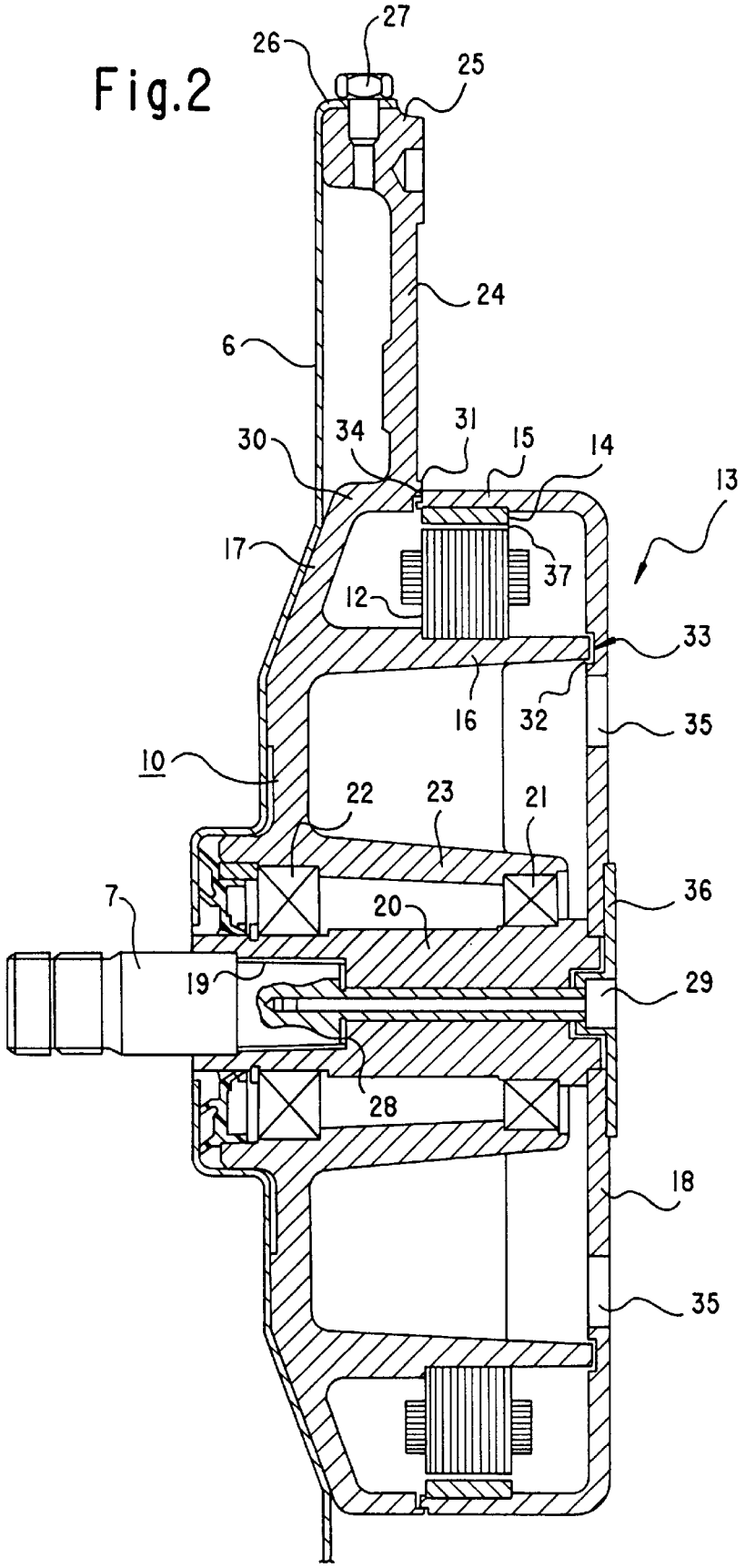
FIG. 2 is an enlarged, section view of another embodiment of a motor according to the invention, which is mounted on a bottom wall.

In order to provide for the secure mounting of the drum shaft 7, a concentric bore 28 shown in FIG. 2 may terminate in a cone 19 having a low angle, which is suitable for holding the shaft 7 in a frictional fit on the shaft 20 of the rotor 13, in the case of a given material pairing. Then, when maintenance work is carried out, the shaft 7 can still be held securely in the cone 19, even after a tension screw 29 has been removed.

Since the stator 10 replaces an otherwise conventional star carrier for the tub 1, there is consequently no need for a special component.

According to FIG. 2, the bottom wall 8 of the laundry drum 4 is stiffened through the use of a star carrier which is an integral part of the stator 10. The star carrier has three spokes, of which two spokes pointing downward extend out of the drawing plane and therefore cannot be seen. Only a spoke 24 pointing upward can be seen in the sectional view of FIG. 2. A bent-round flange 26 of the bottom wall 6 of the tub is fixedly connected to the star carrier through the use of screws 27, at outer ends 25 of the spokes.

A bearing sleeve 23 of the stator 10 contains bearing seats for rolling bearings 21 and 22, having inner rings which are slipped with a good fit onto the rotor shaft 20. The laundry drum shaft 7 is inserted into the concentric bore 28 of the shaft 20 of the rotor 13 at the inner end of the shaft 20 having the cone 19. The shaft 7 is secured through the use of the central tension screw 29, so that the latter connects the shaft 20 of the rotor 13 and the inner rings of the rolling bearings 21 and 22 to the laundry drum 4 in a rotationally fixed manner.

The annular part 17 of the stator 10 has a side facing away from the tub, which carries a short cylindrical part 30 having an externally attached extension 31. The collar-like part 16 is attached, concentrically thereto, to the annular stator part 17 which has a smaller radius but a greater depth. The exciting windings 12 are fastened to the collar-like part 16. The collar-like part 16 has an outer end with an edge which penetrates into an inner annular groove 32 of the bell 18 of the rotor 13. The two elements 16 and 18 form a labyrinth seal 33 with one another. The edge 15 of the bell 18 likewise penetrates in a labyrinth-like manner into the extension 31 of the cylindrical part 17, so that there too a labyrinth seal 34 is obtained. The two labyrinth seals 33 and 34 together with their adjacent portions on the stator 10 (the cylindrical part 30, annular part 17 and collar-like part 16) and on the rotor 13 (the edge 15 and bell 18), form an annular cavity for the exciting windings and the magnetizable poles 14. The labyrinth seals 33 and 34 effectively protect this cavity against penetration of magnetizable dust particles, in particular.

The rotor bell 18 is equipped with perforations 35 between its shaft 20 and the bell edge 15, near the labyrinth seal 33, for better ventilation and cooling of the exciting windings 12 and the magnetizable poles 14. These perforations may advantageously be formed at its edges, in such a way as to assist the access of cooling air through these perforations with a view toward a ventilator effect. In order to improve the cooling effect, so-called swirlers may also be attached to the perforations or in their vicinity. The swirlers ensure that the cooling air is swirled, so that the latter makes better contact with the exciting windings 12 or the collar-like part 16, on which they are mounted.

The motor is constructed in this case as an electronically commutated direct-current motor. It may, however, also be constructed as a so-called switched reluctance motor. In that case, at least the edge 15 of the rotor bell 18 or an inner coating of the edge is formed of a material which has relatively low ferromagnetic conductivity. The structure of the stator is comparable to that of an electronically commutated direct-current motor. The advantage of the reluctance motor is, in particular, that the rotor is constructed more cost-effectively since it has no costly magnetic materials.

The rotor bell 18 is connected to the shaft 20 of the rotor 13 by the same tension screw 29 which serves for fastening the shaft 7 of the laundry drum 4. However, a large-area disk 36 having a can-like depression is pressed into a countersinking for a head of the screw 29, for preassembly and for the provisional retention of this connection. This type of connection is sufficient for the purpose of transporting the motor. The connection is then secured definitively by the tension screw 29. This screw connection may be form-lockingly supplemented in a non-illustrated manner, through the use of a profiled-shaft, profiled-hub, feather-key, taper-groove or keyway connection. A form-locking connection is one which connects two elements together due to the shape of the elements themselves, as opposed to a force-locking connection, which locks the elements together by force external to the elements.

We claim:

1. In a washing machine including a tub having a bottom wall, and a laundry drum having an at least approximately horizontally disposed shaft, a drive device for the washing machine, comprising:

a flat motor for directly driving the laundry drum shaft, said motor including a stator connected to the bottom wall of the tub and a rotor having a rotor shaft with an outer end;

said stator having a central bearing sleeve with between one and two mutually spaced-apart rolling bearings for said rotor shaft including a drum-side rolling bearing defining a plane, and a number of exciting windings distributed circularly on said stator;

said rotor shaft having an end facing the laundry drum, said end having a concentric bore formed therein for receiving the laundry drum shaft, said bore reaching only into the plane of the drum-side rolling bearing; and said rotor having a bell fastened to said outer end of said rotor shaft, said bell having an edge pointing toward the tub, said edge having an inner periphery, and magnetizable poles distributed on said inner periphery and opposing said exciting windings defining airgaps therebetween.

2. The drive device according to claim 1, including a tension screw fastening the laundry drum shaft in said bore from outside said rotor shaft.

3. The drive device according to claim 2, wherein the laundry drum shaft and said bore have mutually matched cones of low inclination.

4. The drive device according to claim 3, wherein said cones have an angle of inclination and a given material pairing resulting in self-locking.

5. The drive device according to claim 1, wherein said rotor shaft and said bell are releasably connected to one another.

6. The drive device according to claim 1, wherein:

said stator has a portion extended substantially parallel to the bottom wall of the tub with an annular part, and said stator has a collar-like part for fastening said exciting windings; and said annular part, said collar-like part, said bell and said edge of said bell together form an annular cavity.

7. The drive device according to claim 6, wherein said edge of said bell and said annular part define a gap therebetween, said bell and said collar-like stator part define another gap therebetween, and said gaps are sealed off by labyrinth-like shapings against a penetration of magnetizable foreign bodies.

* * * * *